United States Patent [19]

Grey

[11] 4,197,914

[45] Apr. 15, 1980

[54] DAMAGE CONTROL SYSTEM FOR CARGO VESSELS

[76] Inventor: Vincent G. Grey, Box 763A, R.D. 2, Sussex, N.J. 07461

[21] Appl. No.: 922,207

[22] Filed: Jul. 6, 1978

[51] Int. Cl.[2] ..... A62C 35/12

[52] U.S. Cl. ..... 169/51; 169/62; 169/70; 169/16; 114/201 R

[58] Field of Search ..... 169/5, 47, 51, 54, 62, 169/66, 68, 70, 16–18; 114/72, 201 R

[56] References Cited

U.S. PATENT DOCUMENTS

| | | | |
|---|---|---|---|
| 1,650,267 | 11/1927 | Gilbert et al. | 169/5 |
| 2,051,103 | 8/1936 | Pohlman . | |
| 2,576,143 | 11/1951 | Rochet . | |
| 3,738,429 | 6/1973 | Heller et al. . | |

FOREIGN PATENT DOCUMENTS

| | | | |
|---|---|---|---|
| 896 of 1852 | | United Kingdom | 169/5 |
| 1380903 | 1/1975 | United Kingdom | 169/62 |

*Primary Examiner*—Charles A. Marmor
*Attorney, Agent, or Firm*—Pennie & Edmonds

[57] ABSTRACT

A system adapted for fighting a fire within areas of a ship that normally are inaccessible to conventional fire fighting equipment. The system includes a fluid carrying conduit supported on the underside of a hatch cover, connector structure for connecting a source of fluid to the conduit and a plurality of openings located along the conduit providing a field of coverage for the fluid which is discharged. The system is adapted both for automatic and manual operation, it may be used for fighting fires with water, fluids, gases and foams, and it may be used to sample ambient conditions within the cargo storing area. The system has particular applicability in use with containerships, but also may be used with vessels of all types which are equipped with hatch covers.

13 Claims, 8 Drawing Figures

FIG. 6.
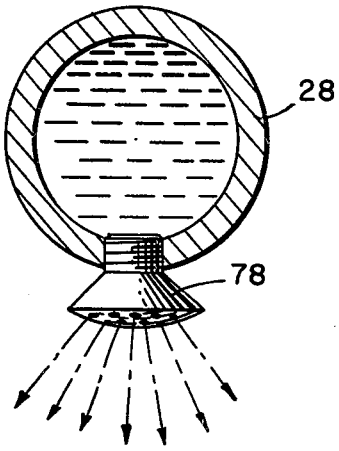
FIG. 4.
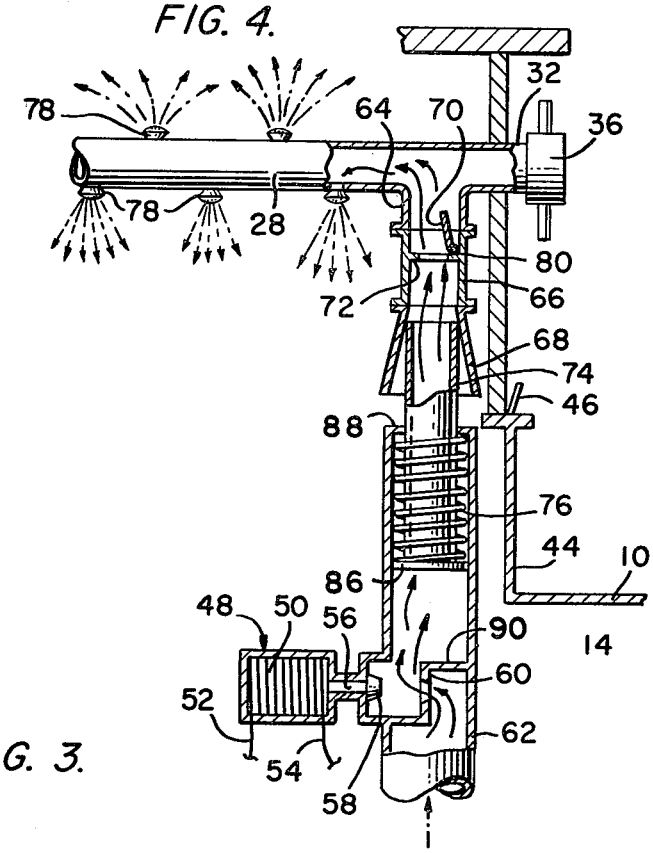
FIG. 3.
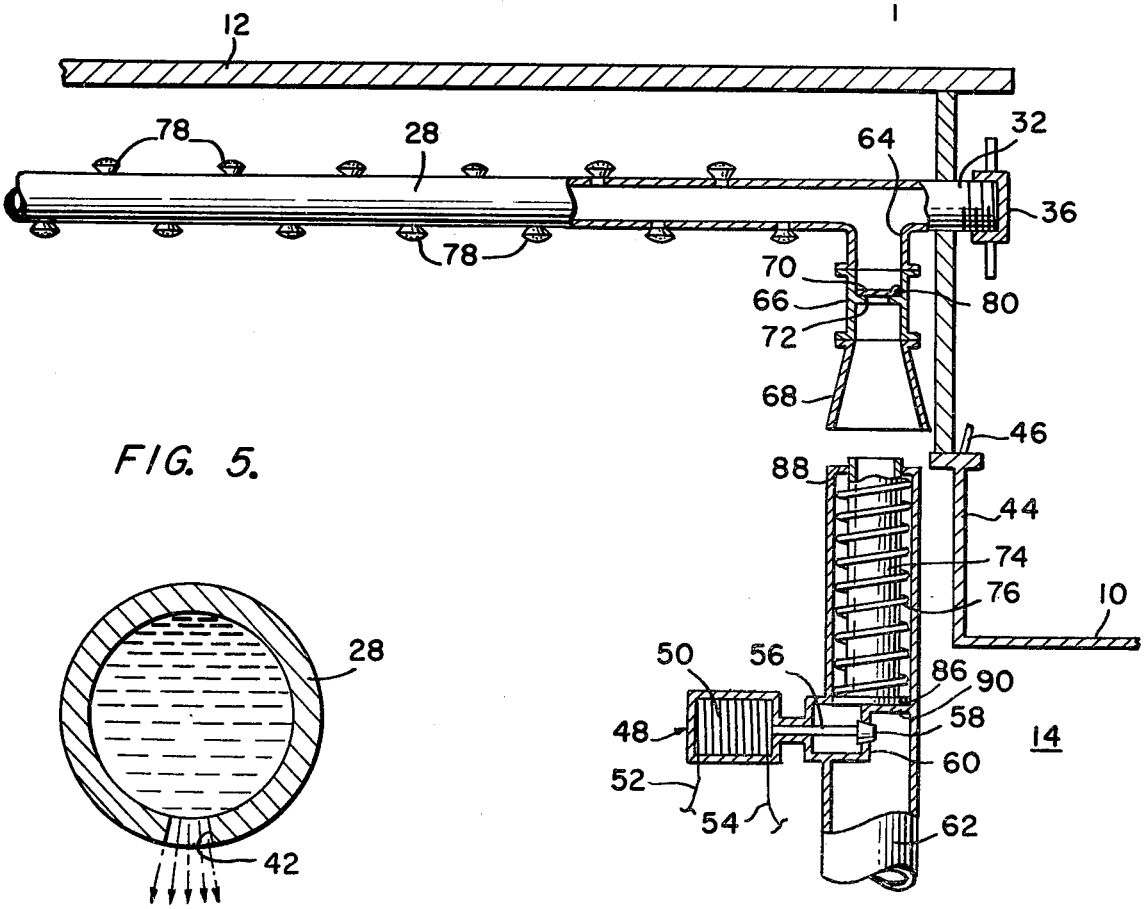
FIG. 5.

DAMAGE CONTROL SYSTEM FOR CARGO VESSELS

BACKGROUND OF THE INVENTION

1. Field of the Invention

The present invention is directed to a system which is particularly adapted for fighting fires below deck, within the hold of a ship, for example, for the protection of cargo which otherwise may be vulnerable to damage because of the inaccessibility of conventional fire fighting equipment. The system is capable both of manual and automatic operation, it may be used to spray water, fluids, foams or gases into the hold, and it may be adapted to monitor the ambient conditions in and around the cargo.

2. Description of the Prior Art

The container industry is one undergoing rapid development and containerization is becoming an accepted manner of shipping cargo, both by land and by sea. Ships characterized as containerships now sail the seas and at specially equipped ports containers may be received directly from the bed of a truck or other land-based transport and loaded on the containership for movement to an overseas market at which the container is removed from the containership for further transport.

The containership is constructed to receive the containers both above and below deck. For this purpose, the containership is provided with a plurality of hatches, each communicating with a hold below deck; and containers may be stored in a plurality of tiers in each hold. When the hold is filled, additional containers normally are received on the closed hatch covers and these containers may be stacked to a height of several tiers. Normally, the containership carries no lifting gear and once the hatch cover is in place, irrespective of whether containers are stacked thereon, the containers within the hold become inaccessible from above, that is through the hatch cover, and they are substantially inaccessible to normal fire fighting equipment from below. All in all, a below-deck fire aboard one of the present-day containerships creates a very dangerous situation and, in fact, in one disaster involving a containership in the recent past, it is considered that damage in the hold would substantially have been non-existent had there been a way to fight a fire as provided by the present invention.

The prior art includes systems for fighting fires aboard ships and representative of the same are the water sprinkler systems described in U.S. Pat. Nos. 2,051,103 to E. A. Pohlman and 2,576,143 to J. C. Rochet. These systems generally are similar in that they are described by piping communicating a sprayer in the several inner compartments of a ship with a reservoir or an inlet fitting at the side of the ship, respectively.

These systems are considered to have little or no applicability of use in a containership whose holds are open to containers received through the hatch and into a respective hold therebelow. This movement of containers prevents the disposition of conduits of the water system above the containers as described by Pohlman and Rochet and, further, these systems are capable only of fire fighting with water from a reservoir, for example. Further still, the Pohlman and Rochet systems are relatively complex in overall design.

U.S. Pat. No. 1,650,267 to V. G. W. Gilbert et al represents a further type of marine fire fighting system and particularly structure for mixing two components of a foam from separate sources and passing the foam to a distributor or head. The Gilbert et al system, other than the material which is used for fire fighting, is like those of Pohlman and Rochet, and it has no applicability of use in combination with the hatch cover of a containership.

U.S. Pat. No. 3,738,429 to V. H. Heller et al relates to a fire extinguishing system having a plurality of branch conduits disposed vertically between stacks of goods in a warehouse and connected to a main conduit supported on the ceiling of the warehouse. As discussed in connection with each of the above patents wherein the delivery conduit of the system is disposed under and supported by the structure between decks, the Heller et al patent has no application to a containership requiring a free opening between the deck and the area for stowage of the containers.

Additionally, none of the prior art systems have capability of providing a monitoring function through access to the system from an on-deck position and none of the systems is adapted to be disposed within an open space under a hatch cover for both monitoring and controlling the conditions within the hold therebelow.

SUMMARY OF THE INVENTION

The present invention is directed to a system which is an improvement upon the prior art and particularly applicable to the monitoring and/or controlling, such as fire fighting of the conditions within the hold of a containership which normally is inaccessible to conventional fire fighting equipment. The system includes an elongated conduit carried on the undersurface of a hatch cover for the hold and disposed in a manner thereby to maximize the coverage to at least an area coextensive with the size of the hatch cover of any medium to be communicated to the conduit. The medium exits the conduit through a plurality of openings preferably disposed at space locations both lengthwise and around the surface. The system is capable of both manual and automatic operation. Thus, at least one end of the conduit normally closed by a cap is accessible from an on-deck location for receipt of a source of the medium which may be water, fluid, gas or foam, and at least one end of the conduit is connected inside of the hatch cover to a source of medium through a remotely controlled unit which functions to open and close the communication. The hatch cover with which the system is adapted for use may be a rigid, single element unit or a foldable unit and because of the accessibility of the conduit from an on-deck location suitable aspirating devices may be employed to draw a sample of air from the hold to monitor ambient conditions therein. Further, important features and advantages of the invention will be set out in the following discussion.

DESCRIPTION OF THE DRAWING

FIGS. 3 and 4 are views in elevation of a portion of the conduit system of FIG. 2 including a connection outside of the hatch cover and a connection inside of the hatch cover, the latter of which is adapted for automatically communicating the conduit system to a water (gas or foam) source by remote control from any location within the containership for fighting a fire within the hold;

FIG. 5 is a view in section as seen along the line 5—5 in FIG. 2;

FIG. 6 is a view like that of FIG. 5 yet illustrating a modification thereof;

DESCRIPTION OF THE PREFERRED EMBODIMENT

Figure 1:
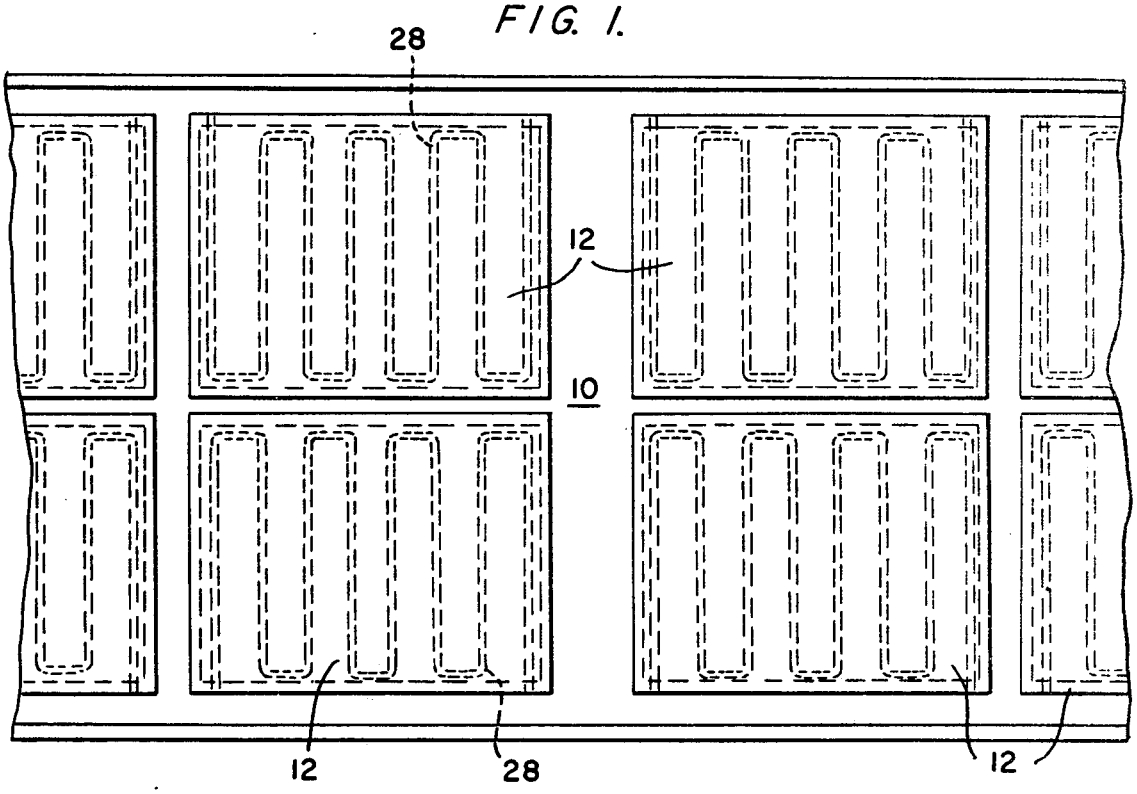
FIG. 1 is a partial plan view of the deck of a containership, illustrating a plurality of hatch covers in place.
Figure 2:
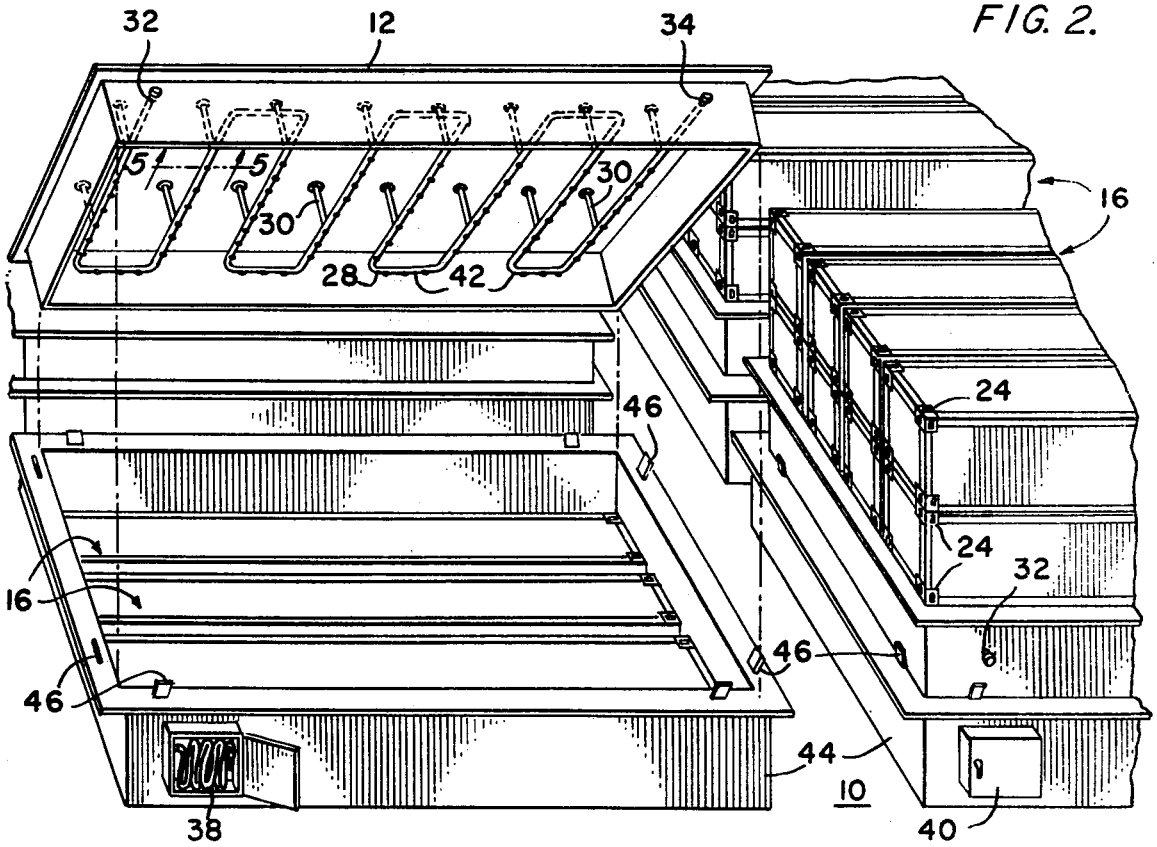
FIG. 2 is a perspective view of a portion of FIG. 1 illustrating a hatch cover unnaturally tilted upward thereby to expose containers in the hold of the containership and illustrate the conduit system supported within the hatch cover, as well as adjacent hatch covers having a plurality of containers stowed thereon.

A portion of the deck 10 of a containership and a plurality of hatches closed by hatch covers 12 at the entrance of the hold 14 may be seen in FIGS. 1 and 2. Containerships may be of varying size and accordingly may accommodate two or three separate holds from port to starboard and, for example, eight or nine holds from the fore to after part of the containership. In order to obtain a better conception of size, it should be appreciated that each container 16 may be twenty (20), thirty (30), or forty (40) feet in length, eight (8) feet in width, and in increments of one-half foot, between eight (8) to nine (9) feet in height.

Each hold may include a plurality of tiers of containers such as six tiers; and, a further plurality of tiers, such as two, three or four tiers of containers may be supported on the individual hatch covers 12. In FIG. 2, the top container tier is visible in the hold and two container tiers are illustrated in position supported by the hatch covers 12. Normally, the loading of the deck containers will be limited to three or four tiers, depending upon weight and so forth, and each container tier is supported by its fittings at each corner 24.

As may be seen in FIG. 1, each group of holds may be separated by a bulkhead (not shown) which may extend across the containership.

As heretofore stated, and as more fully appreciated from the foregoing general discussion, once the stowing of the deck containers is completed, it will be impossible to gain access to the containers in the several holds 14 by opening a hatch cover 12. Further, for all intents and purposes, access to the containers with conventional fire fighting equipment is foreclosed by the bulkhead structure. Thus the containers stowed in the hold will be vulnerable to damage by fire. It is, therefore, an important aspect of the present invention to obviate or substantially reduce the vulnerability of containers in the hold of a containership if a fire shall break out and to monitor the conditions in the hold to obviate or reduce the possibility of such an occurrence.

Referring to FIG. 2, the control system comprises a length of conduit 28, with individual lengths operatively associated with each of the several hatch covers 12 thereby to provide a capability of control of fire or other conditions which may exist in each of several holds. The conduit may be arranged in any particular fashion to attain coverage of a maximum area within the hold with a fire control medium. Since each group of holds may be separated by a bulkhead below deck, it will be possible for the crew of the containership to extinguish a fire or a least keep the fire in check as the containership seeks refuge in a port where further assistance can be rendered. As illustrated in FIGS. 1 and 2, the conduit is arranged in a serpentine fashion which has been found to provide the maximum area of coverage.

As illustrated in the figures heretofore referred to, the conduit 28 is disposed within the cavity under the hatch cover 12. To this end, the conduit is disposed in the free space which may be in the range of about twelve (12) to thirty (30) inches. A plurality of hangers 30 support the conduit along its length. The hangers may comprise an elongated rod-like body including structure for mounting it on the underside of the hatch cover and a collar or the equivalent to be recieved fully or partially around the conduit. Hangers of this type are well known.

The conduit 28 includes a first end 32 and a second end 34, each of which extends through the hatch cover. The ends are at spaced apart locations so that one or the other end may be approached and may comprise the inlet for the fire control medium. A cap 36 which may be threaded or otherwise received at a respective end serves as a closure.

The control system for fighting a fire in a hold may be manually or automatically operated. To this end, a hose 38 may be dispensed from the hose locker 40 and connected to one or the other of the ends of conduit 28. The hose, as should be appreciated, may be in communication with a source of water (not shown) under pressure for flow through the conduit thereby to exit from each of a multiplicity of openings 42. It is recognized that the pressure will drop as the water follows the length of the conduit and exits the openings. Thus, the conduit from the region of the end 32 toward end 34 may be gradually reduced in cross-section and/or the openings therealong may be reduced in cross section to obtain better equilization of pressure.

The system for supplying water under manual operation may be considered conventional.

As best seen in FIG. 2, the locker 40 for hose 38 is located in the coaming 44 upon which the hatch cover 12 is received. Structure on the coaming serves to locate the hatch cover when closed. This structure may include a plurality of lugs, such as lugs 46, or clamps or other structures as are well known.

The control system may be operated automatically if for any reason the prevailing condition prevents manual operation. Automatic operation may be commenced through remote actuation of a control for opening communication between a supply main to the source of water and the conduit 28.

Reference may be had to FIGS. 3 and 4 for purposes of discussion of the manner and means for automatic operation. To this end, the control which preferably comprises a solenoid 48, although it is contemplated that the control either could be operated under compressed air or by an hydraulic source, has an energizing coil 50 activated by a current source (not shown) through a pair of electrical conductors 52 and 54. An armature 56 is carried by the solenoid to retract into the coil when actuated from the normal disposition of FIG. 3. Movement of the armature is against a bias force as may be exerted by a spring (not shown). In FIG. 3, the solenoid is unenergized and the armature including a valve 58 is located within a valve seat 60 in the supply main 62.

Various connecting structure may be used for communicating water from a supply main 62 through the solenoid valve to the conduit 28. For example, a presently preferred connecting structure includes a T-portion 64 (only shown in FIGS. 3 and 4 for the sake of clarity but located in the region of the end 32 of conduit 28) and a pair of sections 66 and 68 of conduit. The former section of conduit includes both a valve 70 and valve seat 72. The latter section of conduit is attached to the former section by any acceptable means. The section of conduit 68 includes a flared end opening toward the supply main 62. An additonal section of conduit 74 capable of movement in response to the flow of water from the source in snorkle-fashion completes the connection between the T-portion 64 and the supply main.

In operation, when the control, such as the solenoid is actuated, the armature 56 and valve 58 retracts from the valve seat 60 (see FIG. 4). Water under pressure from the source is then capable of flow into the conduit 28. The flow causes the section of conduit 74 to move against the bias of a spring 76 into the flared end of the section of conduit 68 to provide substantially a fluid seal below the valve 70. To this end, the flow of water acts against the annular base 86 of the section of conduit 74 causing the section of conduit to move to complete the connection. As indicated, movement of the section of conduit is against the bias of spring 76 supported between the base and a shoulder 88 formed at the end of supply main 62. Thus, the actuation of solenoid 48 results in movement of the section of conduit from a first position juxtaposed to shoulder 90 (FIG. 3) within the supply main 62 to a second position (FIG. 4) at which the flow connection has been completed. Whether this seal or a seal between the T-portion 64 and section of conduit 66, for example, is totally satisfactory is of little concern since the pressure of flow will cause substantially all of the water to enter into conduit 28. That water which leaves the system will serve a useful purpose and have the same effect as it would have in emerging as a spray from the multiplicity of openings 42.

Figure 7:
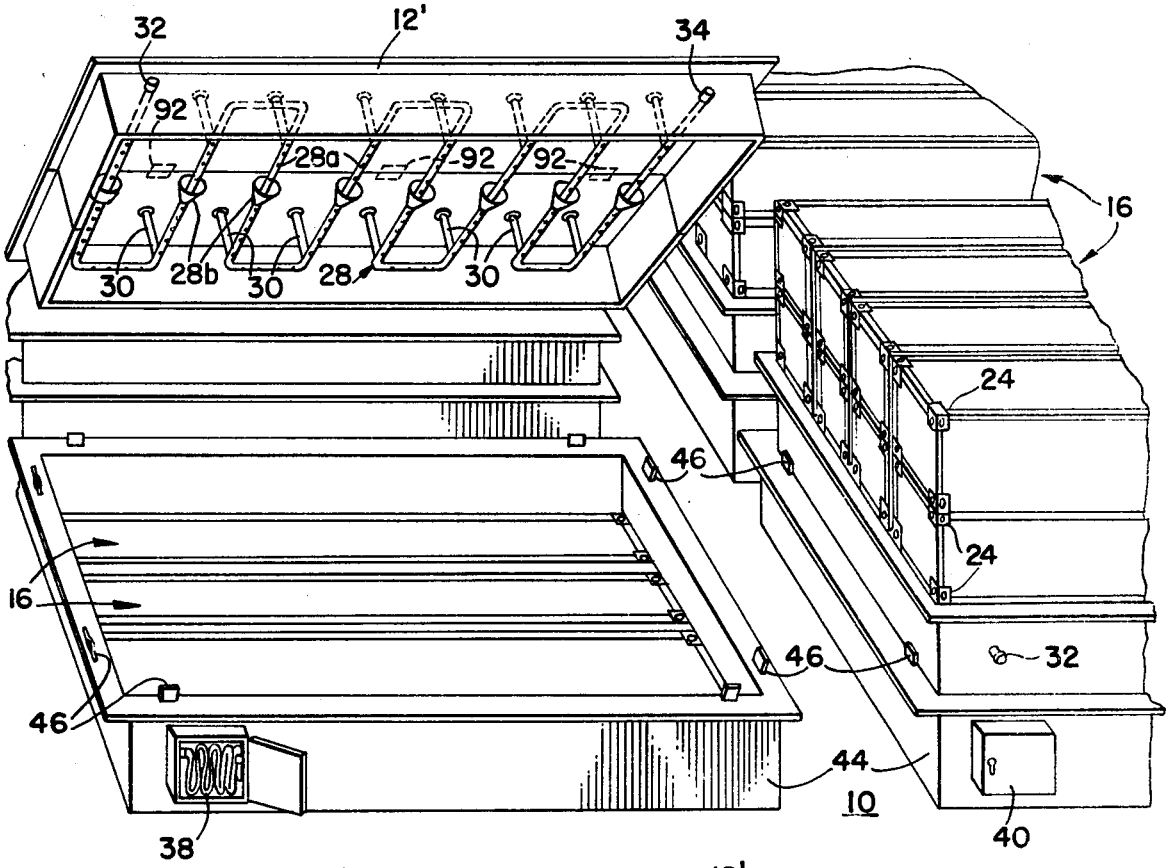
FIG. 7 is a view similar to that of FIG. 2, yet illustrating a modification wherein the hatch cover is a foldable unit; and, FIG. 8 is an elevational view partly in section of the hatch cover in position and folded back upon itself.
Figure 8:
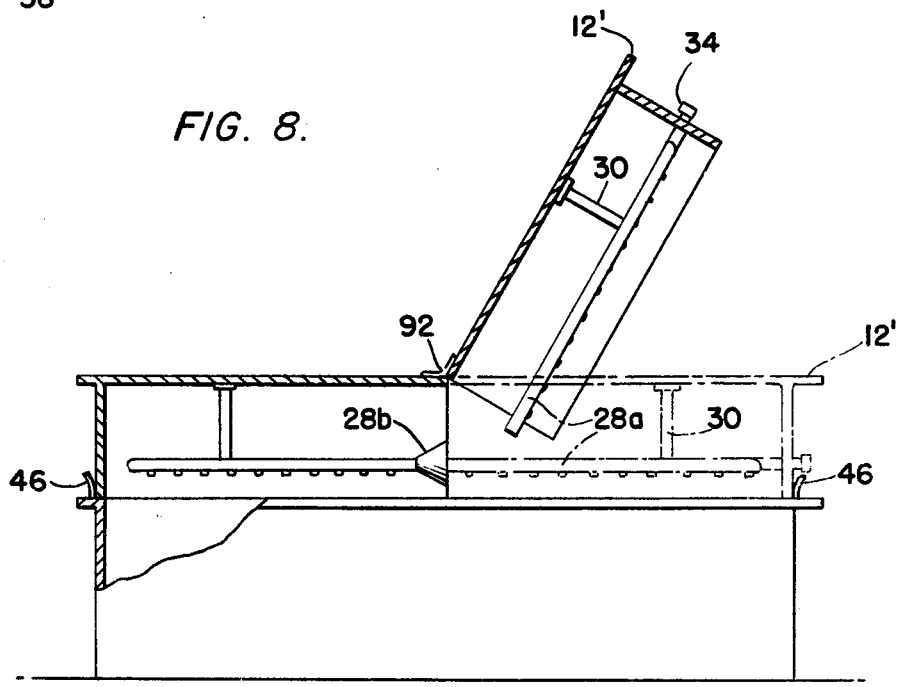

As heretofore set out, the hatch cover 12′ may be a foldable unit as may be seen in FIGS. 7 and 8 and, if so, the manner of connection of the separable or segmented parts of conduit 28 may be somewhat as described with regard to the snorkling engagement of the sections of conduit 68 and 74. Thus, the conduit supported under one foldable portion of the hatch cover or the other may retract from and enter into a flared portion 28*b* of the conduit supported under the relatively stationary portion of the hatch cover. The other end portion 28*a* of the conduit is merely a terminus to allow the portions to engage. A plurality of hinges 92 arranged at the parting line accommodate the folding action. Again, as long as the connection maintains the flow of fluid throughout the entire length of conduit, the fact that a complete seal is not created will be of little concern in the overall operation.

Each opening 42 may be described as an aperture in conduit 28 or the opening may be through a nozzle 80 having a spray head. To this end, the aperture may be tapped to provide an internal thread and the nozzle may be threaded therein. Other manners of connection to achieve a supporting relationship may likewise be resorted to. The aperture or nozzles will be located at spaced dispositions along the length of the conduit 28 to obtain maximum coverage and preferably the aperture or nozzles will be located at dispositions around the circumference of the conduit so that the water will leave the conduit in many possible directional attitudes.

The valve 70 in section 66 which opens under the flow of water during automatic operation isolates the automatic system during manual operation. To this end, in manual operation, the pressure above the valve maintains it in a position juxtaposed to the valve seat 72. A sealing ring (not shown) may be employed around the valve seat and the valve, which may be a flapper valve, pivots about a pin 80. A torsion spring (not shown) or the equivalent may be provided to bias the valve to the closed position.

In either operation in fire control, the bilge pumps will be operated thereby to remove collected water. By the technique of spraying water and removing gathered water, it will be possible to check a fire in a hold or extinguish the fire and seek refuge in a port if assistance is required. The fire control system may be operated to control the radiation of heat from the deck or exterior of the containership, in the event of a fire on deck, which in the disaster previously mentioned appears to be the cause of damage to the below-deck cargo. Thus, the fire control system is capable of dealing with several of the necessary elements of a fire. To this end, the temperature of the hold may be controlled in the event of an on-deck fire to prevent spontaneous ignition. Further, the fire control system may be used to control the oxygen by utilizing foam or an inert gas such as carbon dioxide as the control medium.

The fire control system also may be utilized in another important manner, namely in the sampling of air in the hold thereby to obtain a reading as to toxicity (gas/gas free stability) and temperature. To this end, one of the caps 36 may be removed from the end of conduit 28, the other cap will remain in place, and an aspirator (not shown) may be attached in any manner thereby to draw an adequate sample of air from the hold.

From the above, it should be clear that the fire control system and its adaptation in use below the hatch cover of a containership and above the containers provides a unique manner of monitoring and controlling the ambient conditions within the hold and of fighting a fire in those areas of the hold inaccessible to conventional fire fighting equipment.

Having described the invention with particular reference to the preferred form thereof, it will be obvious to those skilled in the art to which the invention pertains after understanding the invention, that various changes and modifications may be made therein without departing from the spirit and scope of the invention as defined by the claims appended hereto.

Having described the invention, what is claimed is:

1. A control system for ships having a hold below decks adapted to receive cargo and a hatch cover having a cavity therein movable to a position for securing an opening into said hold and when in said securing position isolating said hold from the deck, said control system including a conduit for carrying a fluid, said conduit having a plurality of openings located along its length between its ends, means for supporting said conduit within said cavity of said hatch cover, and means for communicating a fluid to said conduit thereby to exit each of said openings whereby said fluid exiting said openings provides a field of coverage below said hatch cover and at least coextensive with said opening into said hold for fighting a fire in said hold inaccessible to conventional fire fighting equipment.

2. The control system of claim 1 wherein said conduit is of a length longer than any dimension of said cavity and arranged in a pattern to traverse substantially throughout the area of said cavity.

3. The control system of claim 2 wherein said conduit is arranged in a serpentine pattern throughout said cavity and including a plurality of nozzles equal in number to the number of openings in said conduit, each said nozzle received in an opening.

4. The control system of claim 1 wherein said openings are located at substantially equidistant spacing along the length and around the perimeter of said conduit.

5. The control system of claim 1 wherein said supporting means includes a plurality of hangers, each hanger having means at one end for supporting said conduit within the confines of said cavity, and means at the other end for mounting said hanger to the underside of said hatch cover.

6. The control system of claim 1 wherein said communicating means includes a pair of openings in said hatch cover, said conduit ends extending through said respective openings, and cap means removably received on said extending ends of said conduit for closing said fluid communication to said openings.

7. The control system of claim 1 including a main for fluid adapted for connection to a fluid source, connector conduit means coupled between said conduit and said fluid main when said hatch cover is in said securing position, and valve means operable to open communication for fluid from said fluid main to said conduit.

8. The control system of claim 7 wherein said valve means includes a valve seat formed in said connector conduit means and a valve adapted for movement relative to said valve seat, means for moving said valve against said valve seat to close said communication, and means for actuating said valve away from said valve seat to open said communication.

9. The control system of claim 8 wherein said actuating means includes an electrical solenoid, said solenoid comprised of a winding adapted for electrical connection to a source of current, and an armature, one end of said armature supported within said winding and carrying said valve at its other end whereby when said winding shall have been actuated said armature is attracted within said winding against said moving means to open said communication.

10. The control system of claim 7 wherein said connector conduit means includes a T-portion coupled to said conduit, a first section coupled to said T-portion having a flared end, and a second section movable longitudinally of said first section from a first to a second position under conditions of flow of fluid through said valve means, said first and second sections adapted to provide a snorkling engagement.

11. The control system of claim 10 wherein said main for fluid includes a pair of shoulders, said second section having an enlarged base for engaging one of said shoulders, and a spring compressively received between said base and the other of said shoulders to normally bias said second section to said first position.

12. The control system of claim 11 including a second valve means, said second valve means located in said first section and adapted to isolate said conduit and said fluid main, said second valve means comprised of a flapper plate which opens in response to the flow of fluid through said valve means.

13. The control system of claim 3 wherein said hatch cover includes a pair of sections, means for uniting said sections so that one section is stationary and the other section folds back upon the stationary section, and said conduit formed by a plurality of separate lengths, each of said lengths terminating substantially within the plane of said fold, the terminating ends of said lengths disposed below one of said stationary and foldable sections being flared to readily receive the other ends.

* * * * *